US005535462A

United States Patent [19]

Hochschild, III

[11] Patent Number: 5,535,462

[45] Date of Patent: Jul. 16, 1996

[54] WATERBED FRAME STRUCTURE

[75] Inventor: Arthur A. Hochschild, III, Huntington Beach, Calif.

[73] Assignee: American Pacific Plastic Fabricators, Inc., Garden Grove, Calif.

[21] Appl. No.: 342,588

[22] Filed: Nov. 21, 1994

[51] Int. Cl.[6] ..... A47C 21/02

[52] U.S. Cl. ..... 5/451; 5/460; 5/917

[58] Field of Search ..... 5/451, 400, 460, 5/659, 663, 925, 917, 452; 40/658, 686

[56] References Cited

U.S. PATENT DOCUMENTS

| | | | |
|---|---|---|---|
| 2,792,228 | 5/1957 | Chaikin | 40/658 |
| 4,197,760 | 4/1980 | Johenning | 5/286 |
| 4,352,217 | 10/1982 | O'Rourke | 5/451 |
| 4,930,172 | 6/1990 | Johenning | 5/451 |
| 5,117,520 | 6/1992 | Larson | 5/508 |
| 5,201,086 | 4/1993 | Decker et al. | 5/451 |
| 5,203,040 | 4/1993 | Hochschild | 5/400 |

*Primary Examiner*—Steven N. Meyers
*Assistant Examiner*—Fredrick Conley
*Attorney, Agent, or Firm*—Georges A. Maxwell

[57] ABSTRACT

A waterbed frame structure including a rectilinear flotation mattress supporting platform, elongate anchor plates with top surfaces secured to the side portions of the platform, elongate, soft, resilient mattress retaining wall sections extending longitudinally of the anchor plates and having bottom surfaces overlying and opposing the top surfaces of the anchor plates, couplings pivotally connecting the wall sections to the anchor plates for upward and inward pivotal movement to allow for lateral inward movement of linen between the anchor plates and wall sections; and, linen-engaging ridges and linen-receiving grooves at the top surfaces of the anchor plates, the bottom surfaces of the wall sections normally yieldingly conform with the ridges and grooves; linen engaged between the anchor plates and wall sections is urged and held in conforming engagement between the conformed ridges and grooves of the anchor plate and the bottom surfaces of the wall sections.

6 Claims, 5 Drawing Sheets

WATERBED FRAME STRUCTURE

This invention has to do with the art of waterbeds and is particularly concerned with an improved soft-sided waterbed frame structure that is disclosed in the following specification.

BACKGROUND OF THE INVENTION

The present invention has to do with improvements in that form of soft-sided waterbed frame structure that is the subject matter of U.S. Pat. No. 5,203,040, issued Apr. 20, 1993 and entitled, "Soft-Sided Flotation Mattress Frame." The disclosure of U.S. Pat. No. 5,203,040 is incorporated herein by reference.

The waterbed frame structure which is the subject matter of the above-identified U.S. Patent includes a horizontal, rectilinear, platform established of plywood or equivalent material and that defines a flat horizontal upwardly disposed mattress supporting top surface, a downwardly disposed bottom surface, oppositely disposed longitudinally extending, parallel, side edges or side edge portions; and, oppositely disposed laterally extending, parallel, end edges or end edge portions.

The subject prior art frame structure next includes pairs of like elongate side and end wall sections each of which is coextensive with and overlies a related side or end edge portion of the platform. Each wall section comprises a core of soft resilient foam plastic with a thin flexible exterior jacket about its exterior. Each wall section has a flat, downwardly disposed, longitudinally extending bottom surface with substantially straight parallel inner and outer side edges and end edges. The bottom surfaces of the wall sections overlie and oppose related side and end portions of the platform.

The subject prior art frame structure next includes elongate anchor plates to releasably pivotally secure the lower inner edge portion of each wall section to its related side edge portion of the platform. The anchor plates are elongate, flat, horizontal plate-like parts having longitudinally extending outer portions with longitudinally extending inner and outer edges, substantially transversely or laterally extending end edges, downwardly disposed bottom surfaces and flat, smooth upwardly disposed top surfaces. The anchor plates are coextensive with and are in supported engagement atop their related side and end portions of the platform. The plates are suitably fixed to the platform by means of cement, tacks, staples, or the like, as desired or as circumstances might require.

The anchor plates next include elongate longitudinally extending inner edge portions that extend inwardly from the inner edge portions of their outer portions and that are formed with or carry parts of coupling means to engage related coupling parts that are secured to and carried by the wall sections at or adjacent to the inner edges of the bottom surfaces thereof, to couple the wall sections to the anchor plates for upper and inwardly pivotal movement thereof relative to the platform.

The outer edges of the anchor plates have downwardly extending flanges with inwardly projecting lips at their lower edges. The flanges overlie their related outer edges of the platform to dress those edges of the platform. The lips on the flanges engage the bottom surface of the platform and prevent upwardly displacement of the outer edge portions of the plates.

The anchor plates can be made of any suitable material and fabricated in any suitable manner. In practice, the anchor plates have been provided in the form of aluminum and plastic extrusions. The opposite ends of the wall sections and of the anchor plates are angularly related to the longitudinal axes of the wall sections and plates so that each end surface of each wall section and each end edge of each anchor plate establishes flat opposing engagement with its related end surface and end edge of its next or adjacent wall section and anchor plate. That is, the ends of the wall sections and anchor plates are formed so that they establish miter joints at the four corners of the frame structure.

Pivotally connecting the wall sections to the plates at or near the inner edges of the bottom surfaces thereof enables the wall sections to be pivoted inwardly and upwardly. Such pivoting of the wall sections enables the edge portions of bedding items such as linen sheets and sometimes blankets, that normally overlie the tops of the frame structure and depend about the exterior thereof, to be tucked inwardly between the wall sections and the plates when the bed, of which the frame is a part, is "made up." While the foregoing tucking in of bedding appears to be a function that this prior art bed frame structure might effectively perform, it has been found that bedding that has been tucked in, as noted, will not remain tucked in during normal anticipated use of the bed of which the frame is a part. Because the top surfaces of the anchor plates are smooth and the bottom surfaces of the wall sections are necessarily taut, flat and smooth, bedding tucked between them is so insecurely held that it often appears to be expressed outwardly from between the bottoms of the side walls and the plates when the bed structure is sat upon, brushed against or otherwise worked upon or against in such a way as to cause or induce any relative movement of the several related parts.

In addition to the above, the adjacent end edges of related anchor plates establish sharp, right angle, corners at the four corners of the frame structure that are highly subject to causing injury or damage to persons and/or objects that establish contact therewith, during ordinary activity about and/or use of the bed structure of which the frame structure is a part. In practice, if the opposing end edges of adjacent anchor plates do not mate precisely or are caused to part or separate, as when engaged by a person's body, or the like, the related anchor plates define two closely related acute angled corners (45°) that are highly capable of cutting into or slicing that which is brought into contact with them.

OBJECTS AND FEATURES OF THE INVENTION

It is an object of the invention to provide a waterbed frame structure of the general character disclosed in U.S. Pat. No. 5,203,040 and described above that further includes linen-gripping means at the opposing surfaces of the wall sections and anchor plates to engage and releasably hold linen sheets and the like that have been tucked inwardly between the wall sections and anchor plates.

It is an object and a feature of the invention to provide a waterbed structure of the general character referred to above wherein the gripping means includes a plurality of elongate laterally spaced longitudinally extending upwardly projecting linen-engaging ridges and upwardly opening linen-receiving grooves in the anchor plate with which the wall sections yieldingly conform with linen engaged therebetween securely gripped thereby.

Another object and feature of the invention is to provide a waterbed structure of the general character referred to above wherein the gripping means includes strips or patches of friction fabric fixed to the bottom surface of the wall sections.

Yet another object and feature of the invention is to provide a waterbed structure of the general character referred to above wherein the gripping means includes upwardly projecting linen-engaging and upwardly opening receiving grooves in the anchor plates and downwardly disposed linen-engaging friction strips or patches on the bottom surfaces of the wall sections.

It is another object of the invention to provide a waterbed structure of the general character referred to above wherein the adjacent ends of related wall sections are formed to establish mitered joints at the four corners of the bed structure; the ends of the anchor plates terminate longitudinally inward from their related ends of the wall sections that define the mitered corner joints; and, corner caps with horizontal plate portions engaged atop the platform and between the end edges of related anchor plates and having elongate depending flanges extending about and overlying the outer edges of the corner portions of the platform.

It is another object and a feature of the present invention to provide a waterbed structure of the general character referred to above wherein the corner caps are formed of soft resilient plastic material.

It is another object and a feature of the invention to provide a waterbed frame structure of the general character referred to above wherein the corner caps are formed of resilient material and have flat top surfaces with upwardly projecting linen-engaging ridges and upwardly opening linen-receiving grooves to hold linen tucked inwardly into engagement between the corner caps and their related wall sections.

The above and other objects and features of the invention will be apparent and will be made fully understood in the following detailed description of performed forms and embodiments of the invention throughout which description reference is made to the accompanying drawings.

DETAILED DESCRIPTION OF THE INVENTION

Figure 1:
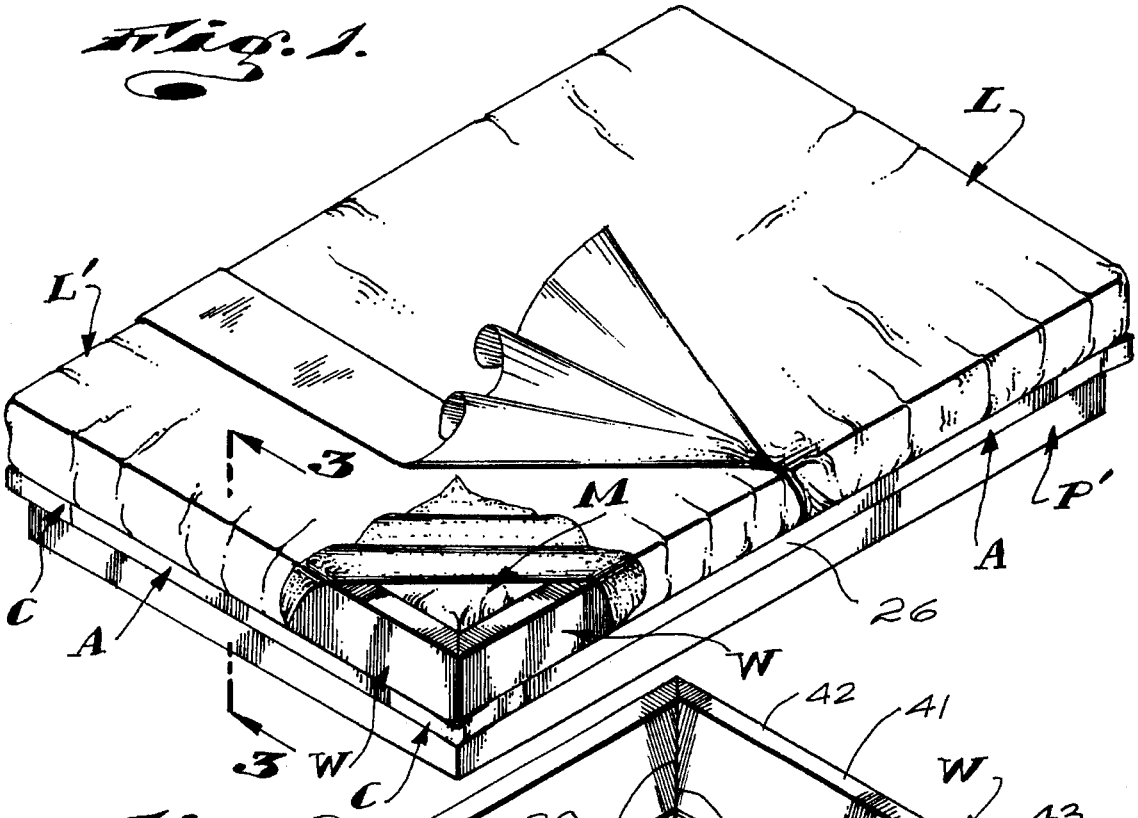
FIG. 1 is an isometric view of a waterbed frame structure embodiment of the invention.

FIG. 1 of the drawings shows a waterbed structure with a flotation mattress M and linen including top and bottom sheets L and L' related to it.

The frame structure includes a mattress-supporting platform P, anchor plates A, corner caps C and mattress retaining side wall sections W.

The platform P is a flat horizontal rectilinear unit made of plywood or the like, the platform has longitudinal and lateral axis and has flat upwardly and downwardly disposed upper and lower surfaces or planes 10 and 11. The platform has right angularly related side and end edges 12. The ends of related side and end edges converge to define four corners.

In practice, the platform is supported in spaced relationship above the floor or deck upon which the frame is supported by a pedestal structure P'.

The anchor plates A are elongate, substantially flat, horizontal strip-like parts. One anchor plate is provided for and extends longitudinally of each side portion of the platform P. But for differences in length between the anchor plates related to the sides and ends of the rectilinear platform, the four plates are alike. Accordingly, I have elected to illustrate and will describe one of those plates and the parts of the frame structure that are related to it.

Figure 2:
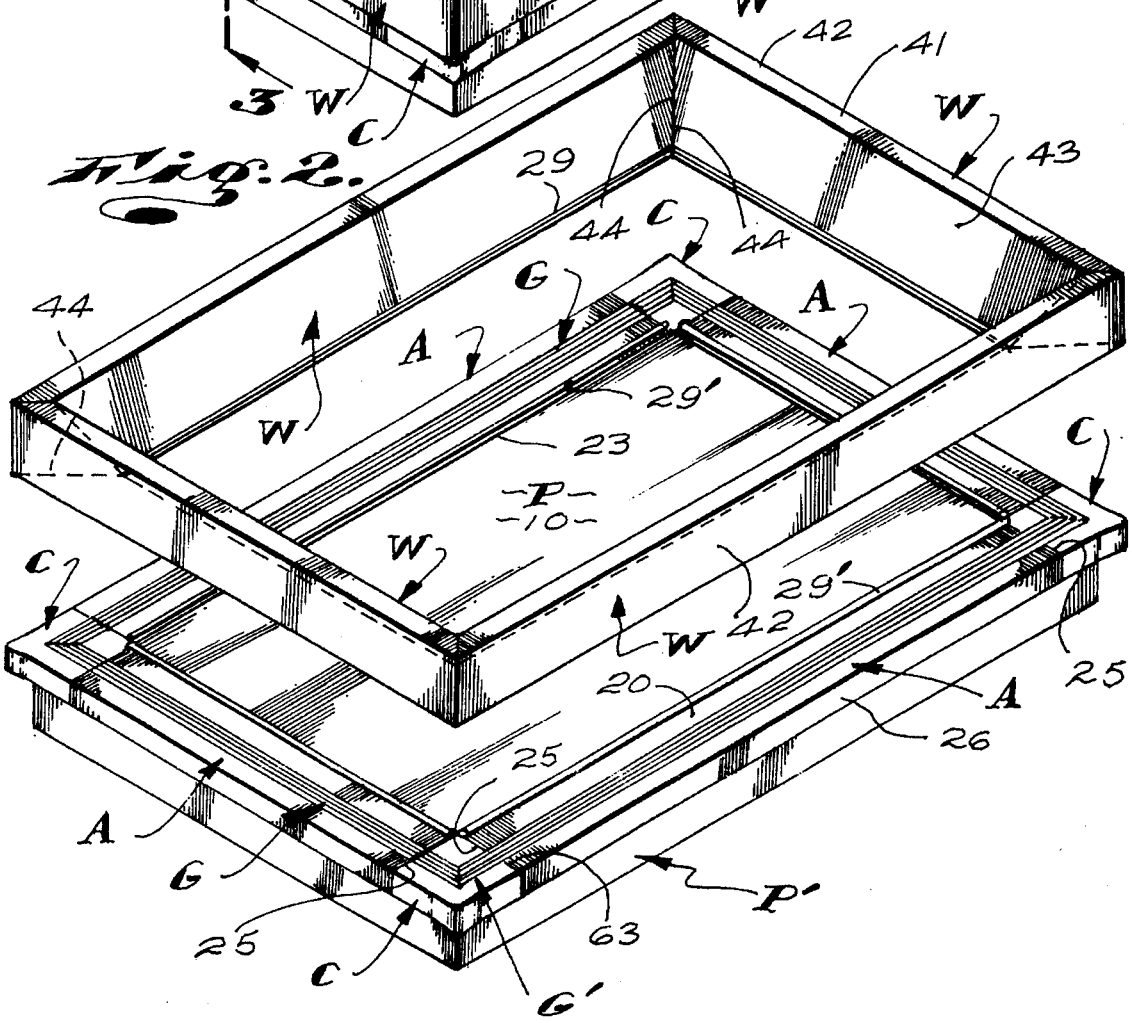
FIG. 2 is an exploded view of the frame structure shown in FIG. 1.
Figure 3:
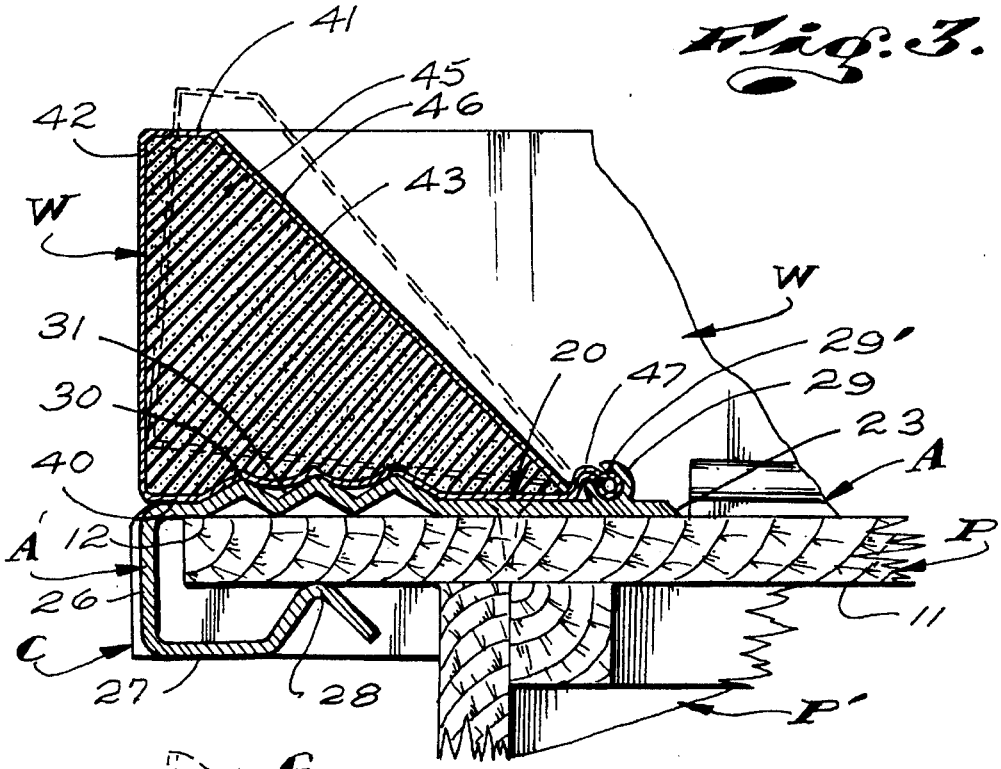
FIG. 3 is an enlarged sectional view of the frame structure and taken substantially as indicated by Line 3—3 on FIG. 1.

The plate A, as best shown in FIGS. 2 and 3 of the drawings, includes a flat horizontal, elongate plate-like part 20 with flat horizontal top and bottom surfaces or planes 21 and 22, longitudinally extending interior and exterior side edges 23 and 24 and laterally or transversely extending ends 25. The plate A is positioned above its related side edge portion of the platform P with its bottom plane in supported engagement on the upper plane of the platform. The plate is fixed to the platform by means of screws, cement, staples, and/or tacks, as desired or as circumstances require.

The ends 25 of the plate are spaced from their related ends of their related side of the platform a distance equal to the lateral extent of the plate so that the related ends of adjacent or related plates do not interfere with each other.

The plate A has a depending longitudinally extending flange 26 along its interior edge 23. The flange dresses and protects its related outer edge 12 of the platform P.

The lower edge of the flange 26 has a longitudinally extending inwardly projecting lip 27 that underlies the lower plane 11 of the platform. The lip is formed with an upwardly projecting longitudinally extending platform engaging rail 28 that establishes yielding pressure engagement with the platform and maintains the parts in proper relationship with each other.

The plate A next includes a coupling part 29' that extends longitudinally of the interior edge portion 24 of the plate and that engages a mating coupling part 29' on a related wall section W, as will hereinafter be described. The part 29' can be and is shown as an upwardly projecting longitudinally extending semi-circular rib-like projection formed on the plate and that defines a forwardly and upwardly opening web and bead receiving channel.

While the plate A can be made of various materials and fabricated in various manners, it is preferably an extruded plastic part.

In the preferred carrying out of the invention, the top plane 21 of the plate A is formed with linen-gripping means G to engage and hold linen sheets and the like that have been tucked or moved laterally inwardly and into engagement with the upper plane of the plate.

Figure 4:
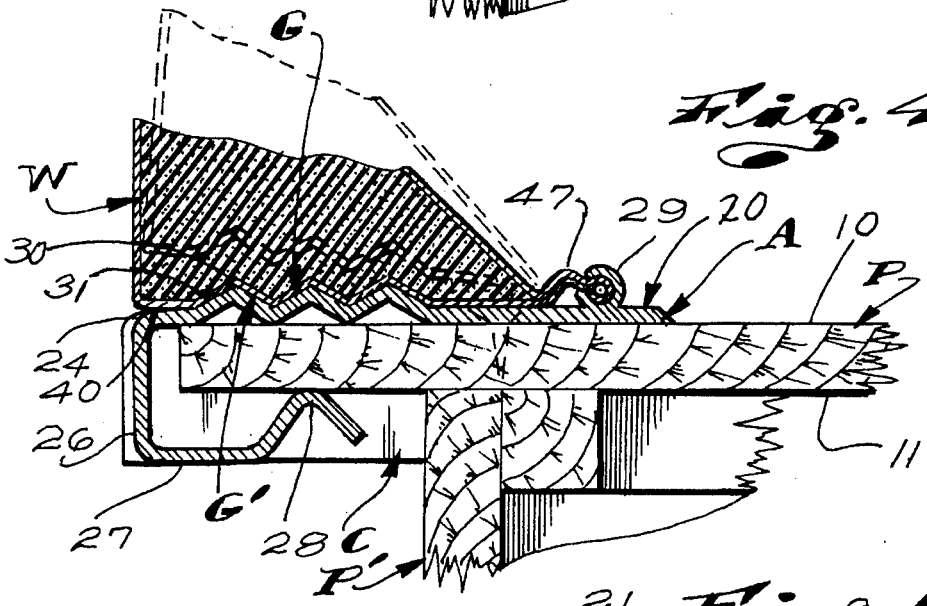
FIG. 4 is an view similar to FIG. 3 and showing another embodiment of the invention.

In FIGS. 3 and 4 of the drawings, the plate A is shown formed with gripping means G in the form of a plurality of elongate parallel, longitudinally extending upwardly projecting linen-engaging ridges 30 and intermediate upwardly opening linen-receiving grooves 31. To facilitate establishing the noted ridges and grooves, the plate is formed in a zig-zag cross-sectional configuration, as shown.

It will be apparent that the number, size (width and depth) and configuration of the ridges and grooves can be varied substantially, as desired or as circumstances might require, without departing from the spirit of this invention.

Figure 5:
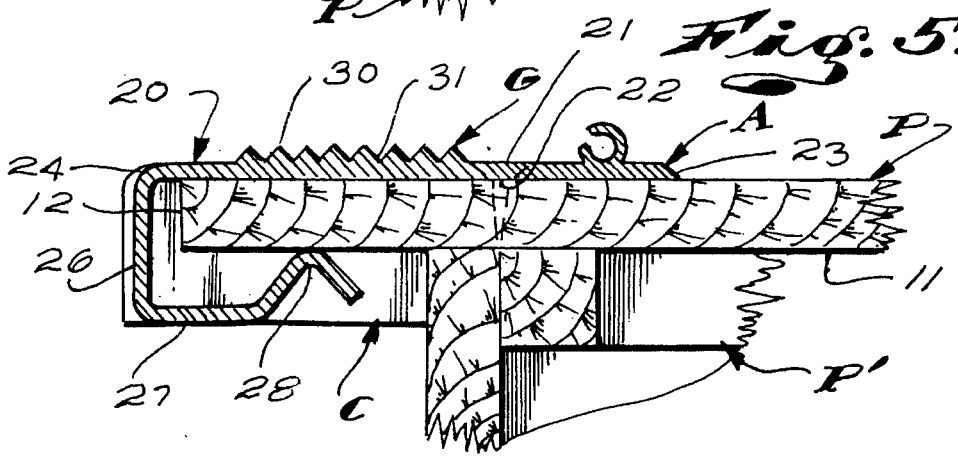
FIG. 5 is view of a portion of the structure shown in FIG. 4 and showing another embodiment of the invention.

As shown in FIG. 5 of the drawings, the ridges and grooves 30 and 31 are sufficiently small so that they can be formed, by extrusion, without having to alter the cross-sectional configuration of the plate to accommodate them.

The means G shown in FIGS. 3 and 4 and in FIG. 5 illustrate number and the size of the range of different sizes of ridges and grooves that can be varied to a great extent.

The frame structure next includes the wall sections W, there being one wall section related to each anchor plate A. But for differences in length, between the wall sections related to the sides and ends of the frame structure, the wall sections are preferably alike. Accordingly, in the following, I will describe but one of the wall sections W. The wall section W is an elongate, horizontal, longitudinally extending unit that is trapezoidal in cross-section. The wall section has flat, vertically spaced horizontal lower and upper surfaces 40 and 41, a vertical outside surface 42 and a inwardly and downwardly inclined inner surface 43. The opposite ends of the wall section are defined by flat end surfaces 44 that are at 45° angles to the longitudinal axis of the wall section and such that each end surface establishes flat butting engagement with a related end surface of a related wall section in the frame assembly.

The wall section is established of a soft resilient foam plastic core 45 and an exterior skin 46 of tough, durable, flexible sheet material, such as plastic fabric, plasticized fabric or the like. The wall section is such that its skin and its core at the lower surface 40 thereof will conform with the gripping means G on the anchor plate A with which it is related.

Figure 6:
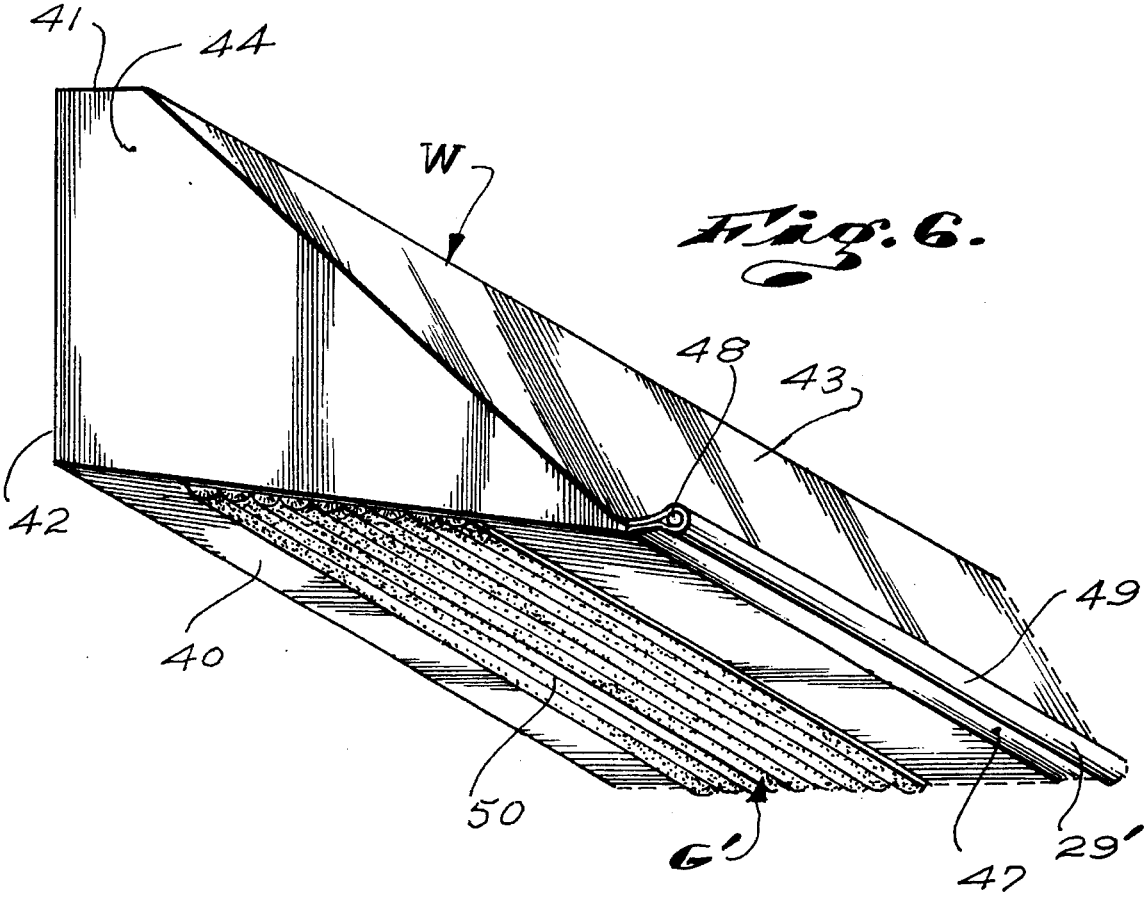
FIG. 6 is an isometric view of a wall section embodying one form of the invention.
Figure 7:
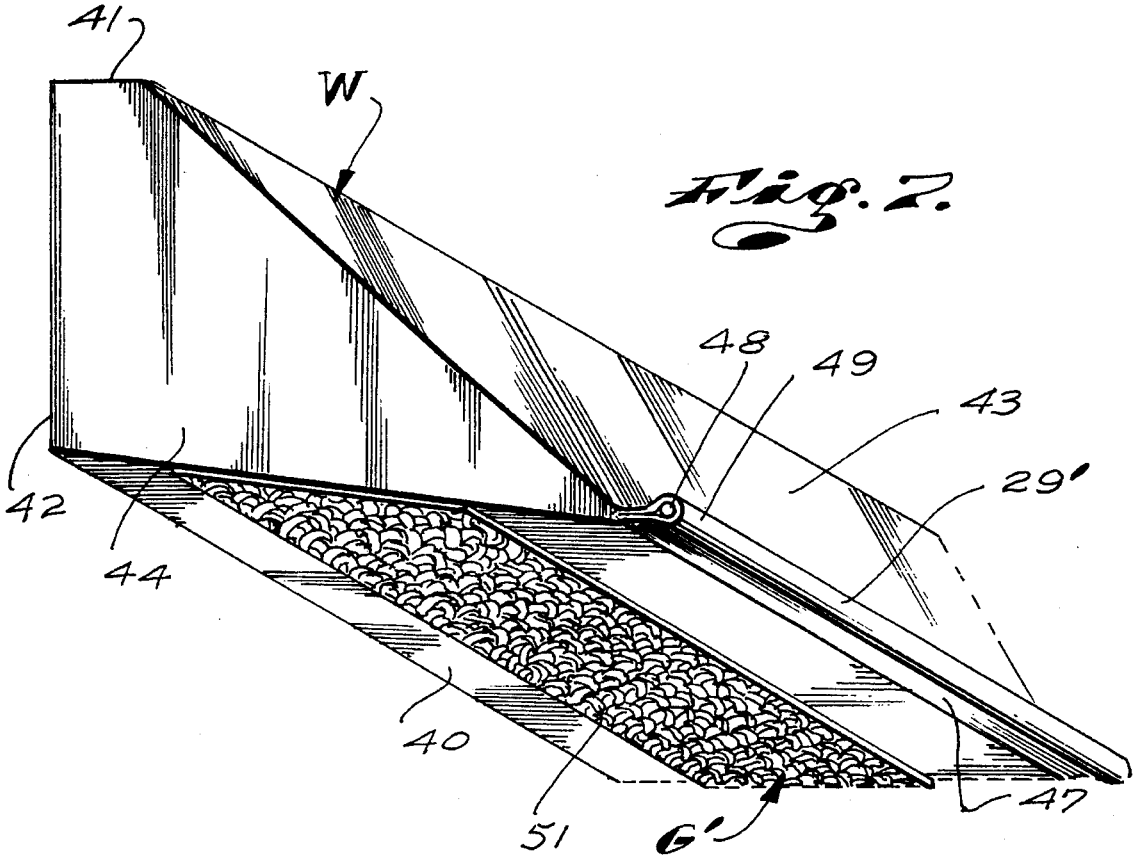
FIG. 7 is a view similar to FIG. 6 showing another embodiment of the invention.

The wall sections W next include a coupling part 29' engageable with the coupling part 29 on the plate A with which the wall section is related, to secure and maintain the wall section and plate assembled. Referring to FIGS. 6 and 7 of the drawings, the part 29' is shown as including an elongate flexible web 47 extending longitudinally of the lower inner edge of the wall section defined by the inside and bottom surfaces of the wall section, and an elongate flexible spline 48 enveloped within the web so that the inner most edge of the web defines an elongate longitudinally extending bead 49.

The bead 49 of the part 29' is captively engaged within the channel defined by the coupling part 29 on the plate. The web 47 of the part 29', that occurs between the bead and the lower inner edge of the wall section, extends through the slot-like opening defined by the part 29 (as shown in FIGS. 3, 4 and 5 of the drawings).

It will be apparent that with the above relationship of parts, the lower interior edge of the wall section W is pivotally secured to the interior edge portion of the plate A and the lower surface 40 normally overlies and opposes the upper surface 40 of the plate. When desired and as circumstances might require, the wall section W can be pivoted upwardly and inwardly relative to the plate A, as shown in dotted lines. More particularly, upon tucking or moving linen inwardly between the plate A and the wall section W, the wall section can pivot relative to the plate, as noted, to facilitate tucking linen inwardly between the plate and the wall section and to thereafter best accommodate the linen.

It is to be noted that when the frame is in use and a water-filled flotation mattress is engaged therein, the mattress bears against the inside surfaces of the wall sections and urges the wall sections down with sufficient force to cause the bottom surface portions of the wall sections to conform with their opposing surfaces and parts of the anchor plates.

In FIG. 3 of the drawings, the lower surface 40 of the wall section W is shown partially conforming with the ridges and grooves 30 and 31 of the anchor plate A.

In one preferred embodiment of the invention and as shown in FIG. 4 of the drawings, the lower surface 40 of the wall section W is formed with linen-gripping means G' that serves to grip linen tucked inwardly between the plate and wall section.

One special form of linen-gripping means G' is shown in FIG. 4 of the drawings. The means G' includes a plurality of longitudinally extending, downwardly projecting linen-engaging ridges and downwardly opening linen-receiving grooves formed in and defined by the core 45 and skin 46 of the wall section, at the lower surface thereof. The ridge and grooves in the wall section W are shaped and positioned so that they normally established meshed interengagement with the grooves and ridges 30 and 31 in the plate A.

It is important to note that the ridges in the wall section are readily and easily deformed and/or compressed, both vertically and laterally. Accordingly, those ridges are such that when the wall section W is moved down into engagement with linen that has been tucked between the wall section and the plate, the ridges first engage and urge the linen down, into engagement over the ridges 30 and into the grooves 31 in the plate. Coincidentally, the ridges on the plate urge the linen up into engagement about the ridges and into the grooves in the wall section. While the linen is being worked upon as noted in the foregoing, the ridges on the wall section deform to compress for irregularities in the shape of the linen so that the volume of linen is best accommodated.

In practice, when linen is tucked between the wall section and the plate, as noted above, the linen tends to elevate and prop up the wall section. In a complete and made-up bed; if portions of the wall sections beneath which linen has been tucked are elevated, the resulting made-up bed appears to have raised outer rim portions and/or a sunken central portion. Such appearances are highly undesirable. With the form of grippery means shown in FIG. 4 and described above, the likelihood that linen tucked beneath the wall sections will elevate and prop them up is greatly minimized or eliminated.

In FIG. 6 of the drawings, the means G' related to the wall section W is a flat strip 50 of friction fabric that is fixed to and overlies a major portion of the lower surface 40 of the wall section.

The terms "friction fabric" as here used refers to or defines flexible sheet material that is highly textured or sufficiently textured so that it has a high and/or notable tendency, when used in my new bed frame structure, to grip and to frictionally hold linen and the like that is in surface-to-surface engagement therewith. One friction fabric that is effective in carrying out my invention is corduroy fabric that is fixed to the bottom surface 40 of the wall section so that its ribs extend longitudinally of the wall section. When corduroy fabric is used, the ridges and grooves formed in the anchor plate are preferably formed to conform with and to normally substantially mesh with the cords and grooves of the fabric.

In practice, the corded surface of the fabric can be coated or treated with a semi-tacky latex or plastic material to enhance the frictional gripping characteristics of the fabric.

Other suitable friction fabrics are gunny fabric and certain deep pile nubby upholstery fabric, such as shown at 51 in FIG. 7 of the drawings.

The gripping and holding characteristics of gunny fabric can be greatly enhanced by coating or otherwise treating the fabric with a latex or plastic material that has a slightly tacky character when cured.

Yet another effective friction material is sheet plastic that has been pierced and firmly formed, in the nature of expanded metal lath.

Figure 8:
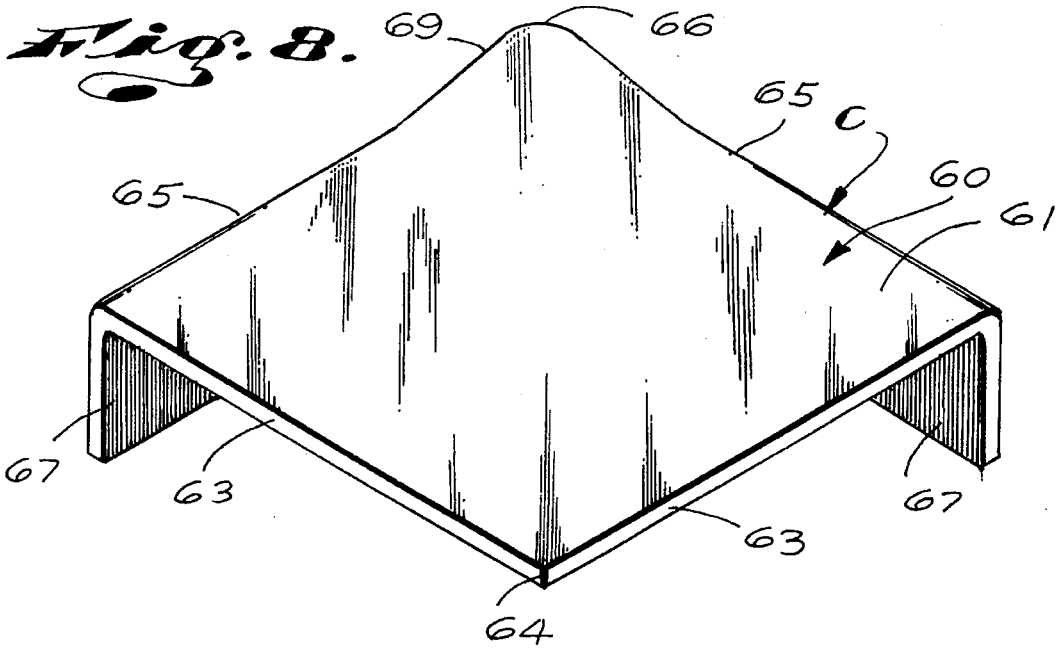
FIG. 8 is an isometric view showing the top and inner sides of a corner cap.
Figure 10:
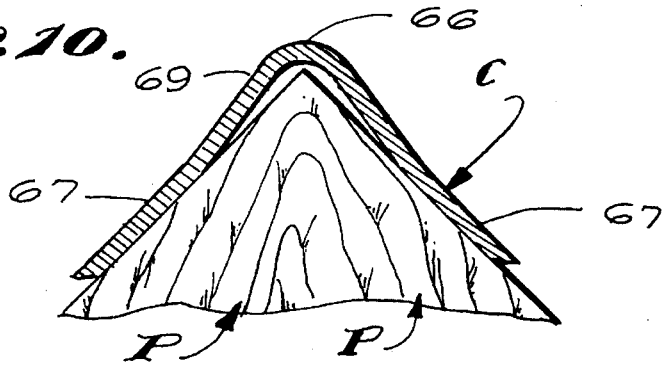
FIG. 10 is a view showing a portion of the cap related to a corner of the platform.
Figure 9:
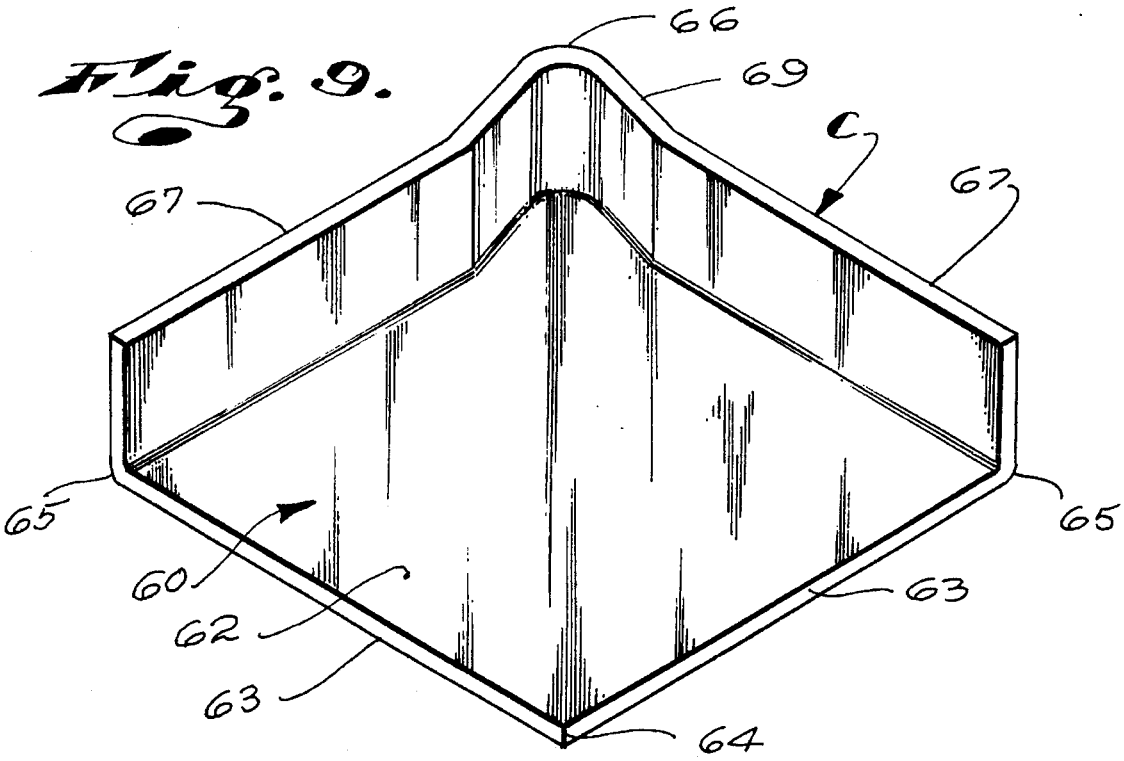
FIG. 9 is an isometric view showing the bottom of the corner cap.

In FIGS. 8, 9 and 10 of the drawings, I have illustrated the basic forms of corner cap C that I provide in carrying out my invention. The arrangement and positioning of the cap(s) C relative to the platform F, anchor plates A and the wall sections W is shown in FIGS. 1, 2 and 10 of the drawings.

Each cap C has a flat horizontal top wall 60 that is substantially square in plane configuration and that defines flat upwardly and downwardly disposed top and bottom surfaces 61 and 62. The wall 60 has right angularly related inner edges 63 that converge at an inside corner 64 and right angularly related outer edges 65 that converge at an outside corner 66. A depending skirt or flange 67 is formed integrally with and depends from the outside edges 65 and about the outside corner 66.

The top wall 60 of the cap is engaged atop and is suitably secured or fixed to its related corner portion of the platform P between related ends 25 of related anchor plates A. The inner edges 63 of the wall 60 oppose and join or abut the end edges 25 of the plates A related thereto. The ends of the flange 67 oppose and join or abut with the ends of the flanges 26 on their related plates A.

In practice, the sharp corners of the platform P are customarily cut off at 45° to eliminate sharp and dangerous right angle corners. Accordingly, the outer corner of the top wall 60 of the cap C and the outer vertical edge established by the flange 67 can be generously radiused.

Alternatively, and as shown, the outer corner portions of the top wall 60 and flange 67 are formed to define an elongate vertically extending radiused protuberance 69 that places the flange in spaced relationship from the corner portion of the platform and eliminates the need to cut off the corner of the platform to accommodate the radiused outside corner of the cap. The cap C can be effectively engaged with and about its related corner of the platform F without the need to cut off or relieve the corner of the platform.

In practice, the cap C is preferably formed of a suitable flexible and resilient plastic material and can be made as soft and as flexible as desired or as circumstances might require.

It is to be noted that one diagonal half of the top wall 60 of the cap C (defined by a line extending between the inside and outside corners 64 and 66) occurs below and opposes the end portion of the bottom surface of one of its related wall sections W and that the other diagonal half of the cap occurs below and opposes the end portion of the bottom surface of its other wall-related section.

Figure 11:
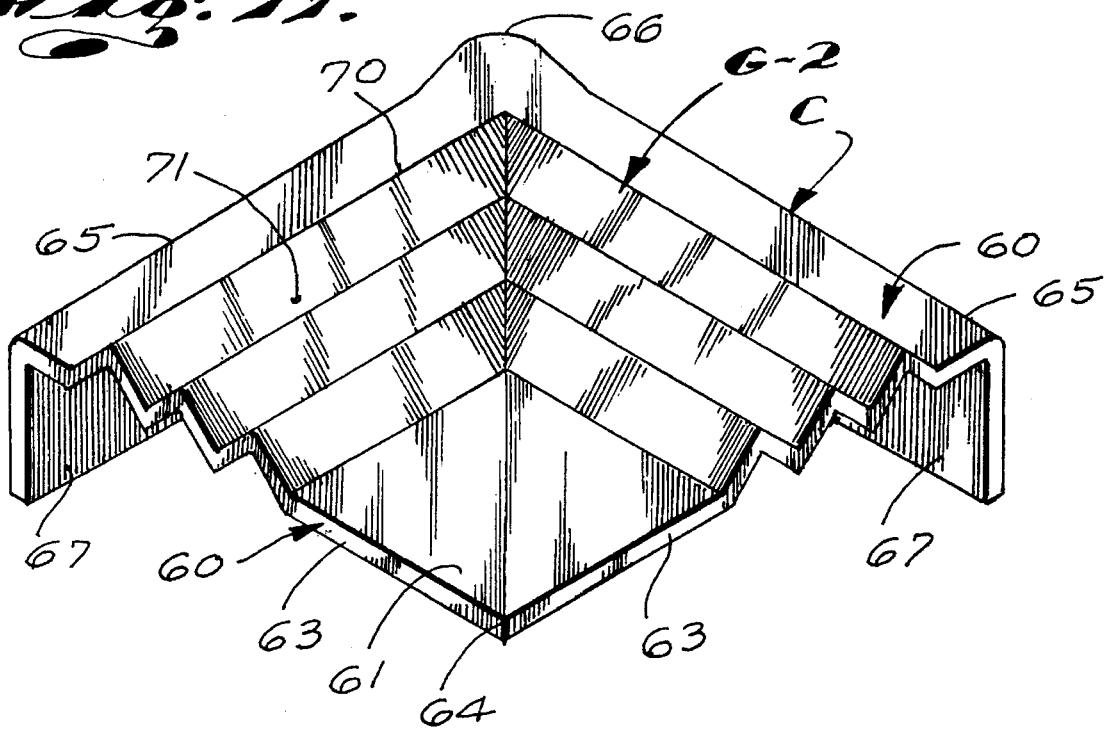
FIG. 11 is a view similar to FIG. 8 showing another embodiment of the corner cap; and, FIG. 12 is a view similar to FIG. 10 and showing yet another form of the corner cap.

In FIG. 11 of the drawings, I have shown a form of cap C that is specifically made to be used in combination with that form of anchor plate A and wall section W shown in FIGS. 3 and 4 of the drawings. The top wall 60 of the cap is formed with gripping means G-2 comprising ridges and grooves 70 and 71 with straight elongate right angularly related end portions the outer ends of which are normal to their related end edges 63 of the top wall and that converge on that diagonal line that divides the top wall between its inner and outer corners. Portions of the ridges and grooves 70 and 71 on each diagonal half of the top wall 60 are aligned and register with the ridges and grooves 30 and 31 in their related anchor plates A and with those portions of the ridges and grooves at the ends of the lower surfaces 40 of their adjacent related wall sections W, in those instances where the wall sections are formed with ridges and grooves.

The ridges and grooves in the top plate of the several caps C join with the ridge and grooves in their several related wall sections W so that the linen-gripping means extends uninterruptedly about the entire outer perimeter portion of the frame structure.

Figure 12:
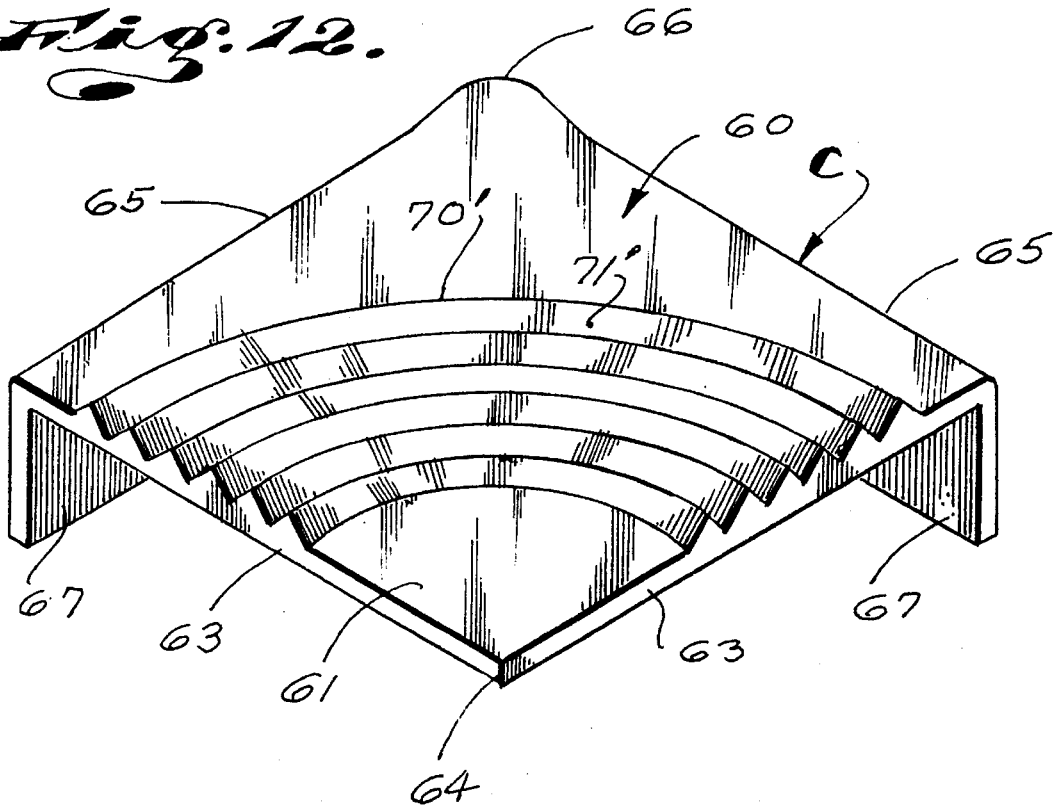

In FIG. 12 of the drawings, I have shown another form of corner cap C including semi-circular ridges and grooves 70' and 71' that are greater in number and substantially small than the ridges 70 and 71 shown in FIG. 11. The ridges and grooves 70' and 71' are particularly suited for use in combination with wall sections W that are not provided with special linen-gripping means; or are provided with gripping means G', such as the friction fabric 51 shown in FIG. 7 of the drawings (that does not present ridges and grooves with which the ridges and grooves on the corner caps might advantageously be made to mesh with).

Having described only typical preferred forms and applications of my invention, I do not wish to be limited to the specific details herein set forth but wish to reserve to myself any modifications and/or variations that might appear to those skilled in the art and that fall within the scope of the following claims.

Having described our invention, I claim:

1. A waterbed frame structure including a flat horizontal rectilinear platform with longitudinally and lateral, extending axes, upwardly and downwardly disposed top and bottom planes and straight right angularly related side and end edges converging at four corners; a corner cap related to each corner of the platform and including a flat horizontal top wall with art upwardly disposed top surface and a downwardly disposed bottom surface opposing and in fixed supported engagement with the top plane of the platform, right angularly related longitudinally and laterally disposed inner edges converging at inside corners, right angularly related longitudinally and laterally disposed outer edges converging at the outside corner and depending flanges extending longitudinally of the outer edges and about the outside corner and overlying portions of related side and end edges of the platform; an elongate flat horizontal anchor plate with upwardly and downwardly disposed upper and lower planes, longitudinally extending interior and exterior edges and transversely extending ends and positioned above each side and end portion of the platform with its lower plane in fixed engagement with the upper plane of the platform and with its ends opposing related inner edges of related corner caps; a soft resilient elongate wall section related to each anchor plate and its related corner caps, each wall section has vertically spaced horizontal upper and lower surfaces with longitudinally extending inside and outside edges and longitudinally and laterally inwardly extending end edges, outside surfaces extending between the outside edges of the upper and lower surfaces, inside surfaces extending between the inside edges of the upper and lower surfaces and longitudinally outwardly and laterally inwardly disposed end surfaces at and extending between the related ends of the upper, lower, inside and outside surfaces; each section is positioned above a related anchor plate and corner caps with its lower surface opposing the upper plane of the anchor plate and top surfaces of the corner caps and with its end surfaces in opposing engagement with related end surfaces of related wall sections; coupling means pivotally coupling lower inner edges of the wall sections defined by the inside and lower surfaces to the inner interior edge portion of their related anchor plates to prevent lateral displacement thereof and to allow for upward and lateral inward pivotal movement of the wall sections relative to the anchor plates to accommodate linen moved laterally inwardly into engagement between the wall sections of their related anchor plates and corner caps; a linen-gripping means to engage and releasably hold linen moved laterally inwardly into engagement between the wall sections and their related anchor plates and corner caps, the gripping means includes linen engaging parts on the upper planes of the anchor plates; those portions of the soft resilient wall sections that define the lower surfaces of the wall sections yieldingly conform with and urge linen positioned between the wall sections and their related anchor plates and corner caps into conformed engagement with the linen engaging parts.

2. The waterbed frame structure set forth in claim 1 wherein the parts of the linen-gripping means include a plurality of laterally spaced upwardly projecting linen-engaging ridges and upwardly opening linen-receiving grooves between the ridges formed in the upper planes of the anchor plates.

3. The waterbed frame structure set forth in claim 2 wherein the parts of linen-gripping means include a plurality of downwardly projecting linen-engaging ridges and downwardly opening grooves at the lower surfaces of the wall sections and normally meshed with the ridges and grooves in the anchor plates.

4. The waterbed frame structure set forth in claim 3 wherein the linen-gripping means includes a plurality of laterally space linen-engaging ridges and grooves formed in the top surfaces of the corner caps and with which related portions of the ridges and grooves in lower surfaces of the wall sections are normally meshed.

5. The waterbed frame structure set forth in claim 1 wherein the linen-gripping means includes flexible friction fabric at the lower surfaces of the wall sections that oppose the upper planes of the anchor plates and the top surfaces of the corner caps and that fictionally hold linen positioned there below.

6. The waterbed frame structure set forth in claim 1 wherein the anchor plates have longitudinally extending downwardly projecting flanges extending longitudinally of and overlying their related side and end edges of the platform, longitudinally extending inwardly projecting lips on the flanges underlying related edge pertains of the platform in vertical spaced relationship therewith and longitudinally extending upwardly projecting rails on the lips and yieldingly engaging the bottom plane of the platform.

* * * * *